US006701741B2

(12) United States Patent
Liu

(10) Patent No.: US 6,701,741 B2
(45) Date of Patent: Mar. 9, 2004

(54) ROOM AIR-CONDITIONER

(75) Inventor: Wan Min Liu, Sclangor (MY)

(73) Assignee: O.Y.L. Research & Development Centre Sdn. Bhd. (MY)

( * ) Notice: Subject to any disclaimer, the term of this patent is extended or adjusted under 35 U.S.C. 154(b) by 0 days.

(21) Appl. No.: 10/116,858

(22) Filed: Apr. 5, 2002

(65) Prior Publication Data

US 2002/0157415 A1 Oct. 31, 2002

(30) Foreign Application Priority Data

Apr. 6, 2001 (AU) ..... PR4280

(51) Int. Cl.[7] ..... F25D 17/06
(52) U.S. Cl. ..... 62/429
(58) Field of Search ..... 62/429, 262, 305, 62/279, 277, 263

(56) References Cited

U.S. PATENT DOCUMENTS 2,870,614 A * 1/1959 Renner et al. ..... 62/429
3,908,393 A * 9/1975 Eubank ..... 62/305
4,013,120 A * 3/1977 Rheinheimer ..... 165/48.1
5,117,652 A * 6/1992 Takeuchi et al. ..... 62/291
5,222,374 A * 6/1993 Thompson et al. ..... 62/305
5,415,011 A * 5/1995 Gilmore et al. ..... 62/262
5,605,052 A * 2/1997 Middleton et al. ..... 62/280
5,638,693 A * 6/1997 Baek ..... 62/262
5,987,908 A * 11/1999 Wetzel ..... 62/259.1
6,067,812 A * 5/2000 Bushnell et al. ..... 62/280
6,085,539 A * 7/2000 Meyer ..... 62/285
6,155,065 A * 12/2000 da Silva ..... 62/262
6,247,326 B1 * 6/2001 Likitcheva ..... 62/305
6,367,280 B1 * 4/2002 Funabasama et al. ..... 62/454

FOREIGN PATENT DOCUMENTS

JP 406147531 A * 5/1994

* cited by examiner

*Primary Examiner*—William C. Doerrler
*Assistant Examiner*—Mohammad M. Ali
(74) *Attorney, Agent, or Firm*—Frost Brown Todd LLC

(57) ABSTRACT

A room air-conditioner (10) for installation into a pre-constructed aperture through a building wall (34) has a depth substantially equivalent to the wall thickness and is adapted to stand at floor level within said aperture with front and rear covers (11, 12) flush with internal and external surfaces of the wall, respectively. The necessary compact design is achieved by stacking the components vertically within the air-conditioner whereby the condenser coil (16) is at the bottom and air for the condenser is drawn in and extracted from the rear whereas the evaporator coil (22) is towards the top and air for the evaporator is drawn in and extracted from the front. Fans (19, 24) for each coil are arranged coaxially and driven by a single motor (21). The coils have a C-shaped configuration. Condensate is collected from the evaporator coil in containers (29, 31) and is used to cool refrigerant pipes (30, 32) entering and leaving the condenser coil. The condensate may also be sprayed in a fine mist over said condenser coil.

13 Claims, 8 Drawing Sheets

ROOM AIR-CONDITIONER

BACKGROUND OF THE INVENTION

The present invention relates to air-conditioners and more particularly to room air-conditioners.

Fixed room air-conditioners of the conventional type generally comprises wall-mounted units, window mounted units, or split-system units where the evaporator and room air-fan may be wall or window mounted and the compressor, condenser and associated equipment are remotely located in order to reduce noise levels in the room.

Generally there are a number of detractions to using the aforementioned units not the least of which involve the installation costs and the relatively poor aesthetics which result from the unit projecting externally from the building wall or window. In the case of the split-system unit aesthetics are not a detraction since the major equipment is installed remotely or at least externally of the building and normally in a location which does not detract from the building aesthetics, but in this case the installation costs are relatively high.

BRIEF SUMMARY OF THE INVENTION

It is an object of the present invention to provide an improved integrated (as opposed to split-system) room air-conditioner and a method of installation which obviates or at least reduces the relatively high installation costs and poor aesthetics of conventional fixed room air-conditioners.

It is another object to provide an integrated room air-conditioner which has improved operating efficiency and/or manufactured cost over conventional room air-conditioners.

Accordingly, in one form the invention provides a room air conditioner for installation into a pre-constructed aperture through a building wall, which aperture extends upwardly from the building floor level, said air-conditioner having a depth substantially equivalent to the wall thickness and being adapted to stand at floor level within said aperture with front and rear faces substantially flush with internal and external surfaces of said wall, respectively.

Preferably cooling air for the air-conditioner condenser coil is drawn in and extracted solely through the rear of said air-conditioner.

Preferably said air-conditioner includes fastening means for attaching said air-conditioner to installation brackets provided within said aperture.

Preferably said condenser coil is mounted on or near a base pan of the air-conditioner adjacent said rear face thereof and an evaporator coil of the air-conditioner is mounted above the level of the condenser coil and adjacent said front face thereof, a first fan is provided above the level of said condenser coil for providing said cooling air for said condenser coil and a second similar fan is provided for drawing room air through said front face, over said evaporator coil whereby it is cooled, and discharging said cooled air into said room, and a single electric motor is provided for driving said fans.

Preferably said condenser and evaporator coils are of C-shaped cross-section.

In a further form the invention provides a room air-conditioner wherein a single electric motor is used to drive both an evaporator fan for drawing room air through an evaporator coil and discharging said air back into said room, and a condenser fan for drawing external air through a condenser coil for cooling purposes and discharging said air externally of said room.

Preferably said shafts extend vertically and said fans draw air into the fan axially and discharge the air radially.

Preferably said fans are mounted in coaxial alignment and said electric motor is mounted between said fans with its axis coaxial therewith, the shaft of said motor being connected at respective ends directly with drive shafts of the fans.

Preferably said fans are mounted with their rotational axes coaxial and said motor is arranged between said fans with the motor rotational axis coaxial with the rotational axes of said fans.

In a still further form the invention provides a room air-conditioner for location in an external wall of the room and wherein condensate collected from an evaporator coil is utilized to cool refrigerant pipes entering and leaving a condenser coil of the air-conditioner.

Preferably said condensate is also sprayed onto said condenser coil for cooling purposes.

Preferably a drain pan under said evaporator coil collects said condensate and pipe means delivers said condensate by gravity to container means adjacent said condenser coil, inlet and outlet pipes of said condenser coil passing through said container means and thereby being cooled by said condensate and thus providing further cooling to said refrigerant.

Preferably said pipe means comprises one or more pipes extending from said drain pan to said container means, and said container means comprises separate containers for said inlet and outlet pipes of said condenser coil.

BRIEF DESCRIPTION OF THE DRAWINGS

In order that the invention may be more readily understood, particular embodiments will now be described with reference to the accompanying drawings wherein.

DETAILED DESCRIPTION OF THE INVENTION

Figure 3:
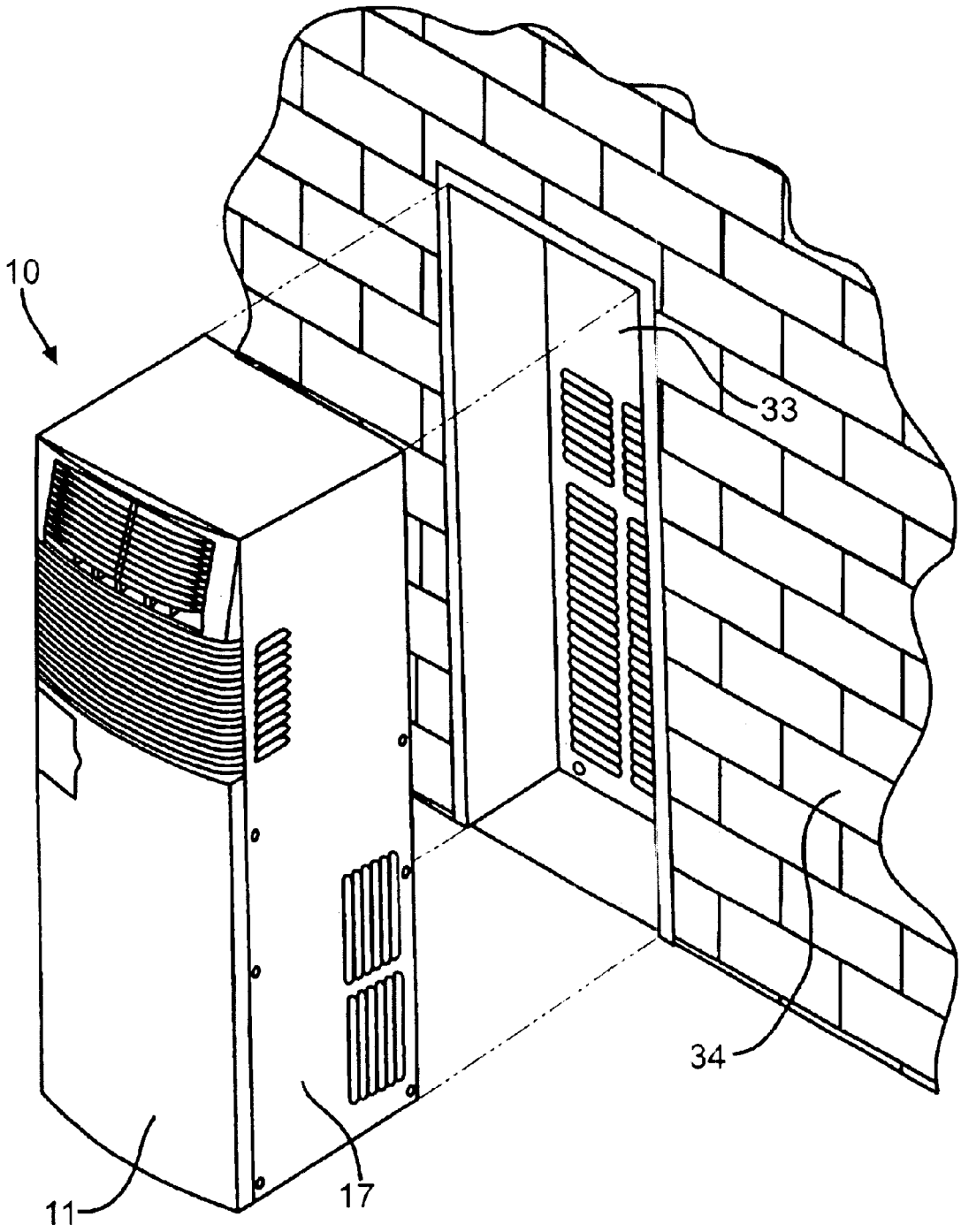
FIG. 3 is a perspective view of the air-conditioner and suitable wall cavity for accommodating the air-conditioner.

The air-conditioner according to this embodiment is adapted to stand on the floor and fit into a pre-constructed aperture 33 (FIG. 3) in an external building wall 34. In the case of new buildings, the pre-constructed aperture could be made during building construction and would preferably have a removable panel (not shown) covering the aperture until such time as an air-conditioner is to be installed. In the case of pre-existing buildings, it would be necessary to have a builder construct an aperture within an external wall of the building, of a suitable size to accommodate the air-conditioner according to this invention. The aperture would extend vertically from floor level to a height corresponding substantially with the height of the air-conditioner and would incorporate suitable brackets therein and fastening means (not shown) to contain the air-conditioner.

The air-conditioner 10 according to the invention has a depth (front to back dimension) which is generally equivalent to a building wall thickness, say, about 250 mm. The width is also about 250 mm and the height approximately 815 mm. This means that the air-conditioner 10 can be slid into the aforementioned wall aperture without the need to lift the air-conditioner above the floor and once in position in the aperture the front cover 11 is virtually flush with the inner wall surface and the back cover 12 is flush with the building external wall surface. Therefore, once a building is constructed with a suitable aperture and mounting brackets for the air-conditioner according to this invention, a skilled tradesman is not required for installation purposes. In other words the consumer is able to slide the air-conditioner into the aperture, fix it in position with the pre-installed brackets and plug it into a suitable electrical power outlet. As will be evident, it is a "do-it-yourself" installation once the necessary aperture appears in a building external wall. The fact that both the front cover 11 and the back cover 12 fit flush with the respective inner and outer wall surfaces means that there is no unsightly protrusions to be seen from the outside which is especially advantageous from the viewpoint of building aesthetics.

As is evident in FIG. 1, the air-conditioner consists essentially of a base pan 13 adapted to rest on the floor or other surface on which the air-conditioner is installed. A compressor 14 and associated accumulator 15 are mounted on the base pan 13 and a condenser coil 16 is mounted on the base pan 13 and located at the rear of the base pan behind the compressor 14 and accumulator 15. The condenser coil 16 is of semi-cylindrical or C-shaped configuration is space saving and provides a larger surface for heat exchange which in turn gives higher capacity and more airflow to the coils.

Figure 1B:
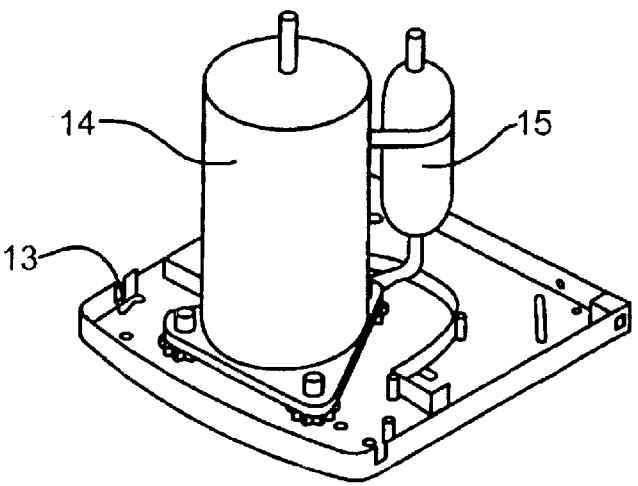
FIGS. 1(*a*)–(*l*) are perspective views showing, progressively, assembly of the main components of an air-conditioner according to the invention.
Figure 1C:
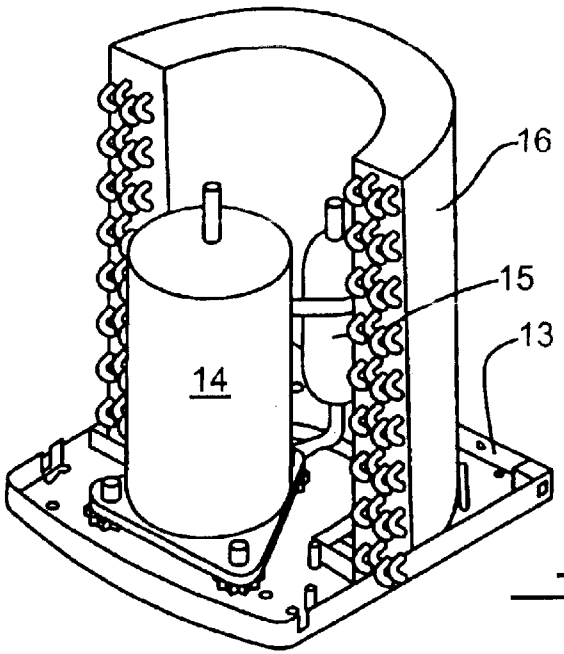
Figure 1A:
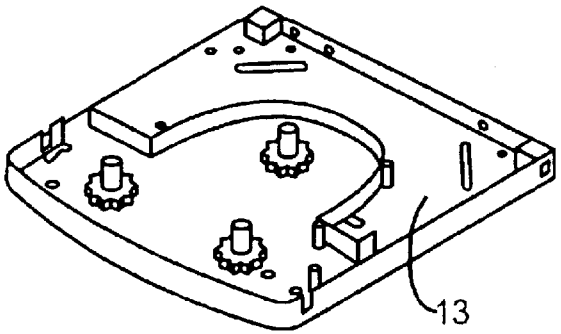
Figure 1E:
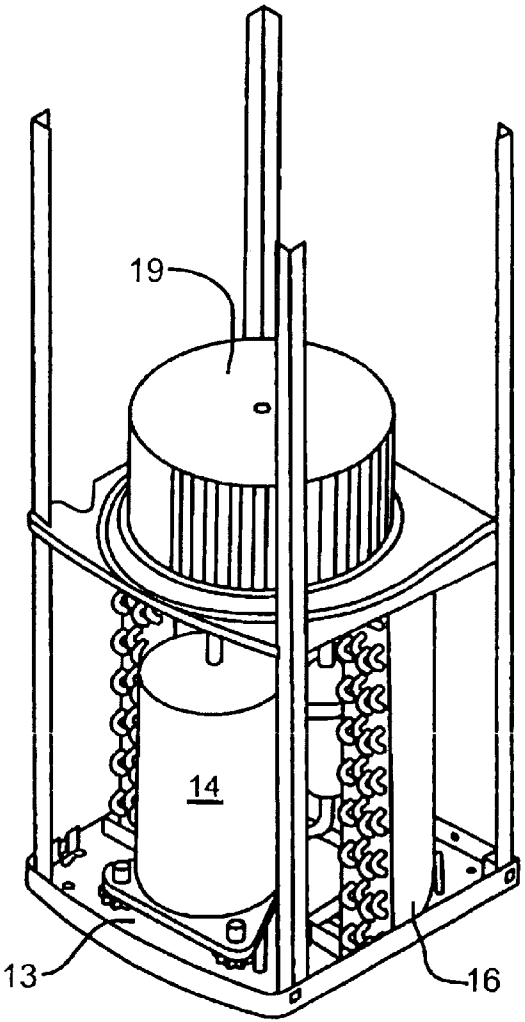
Figure 1D:
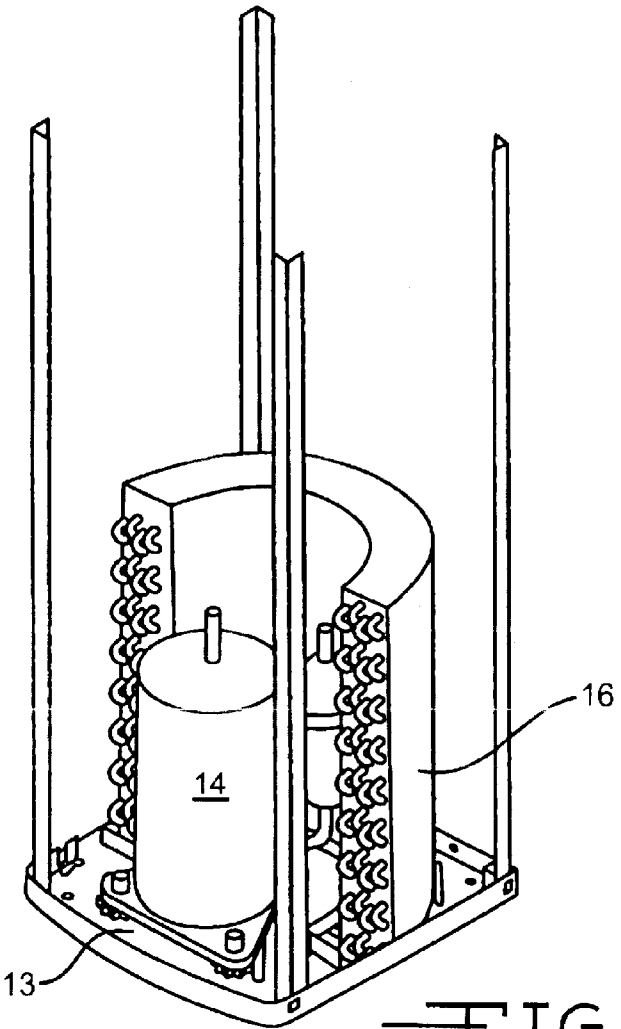
Figure 1G:
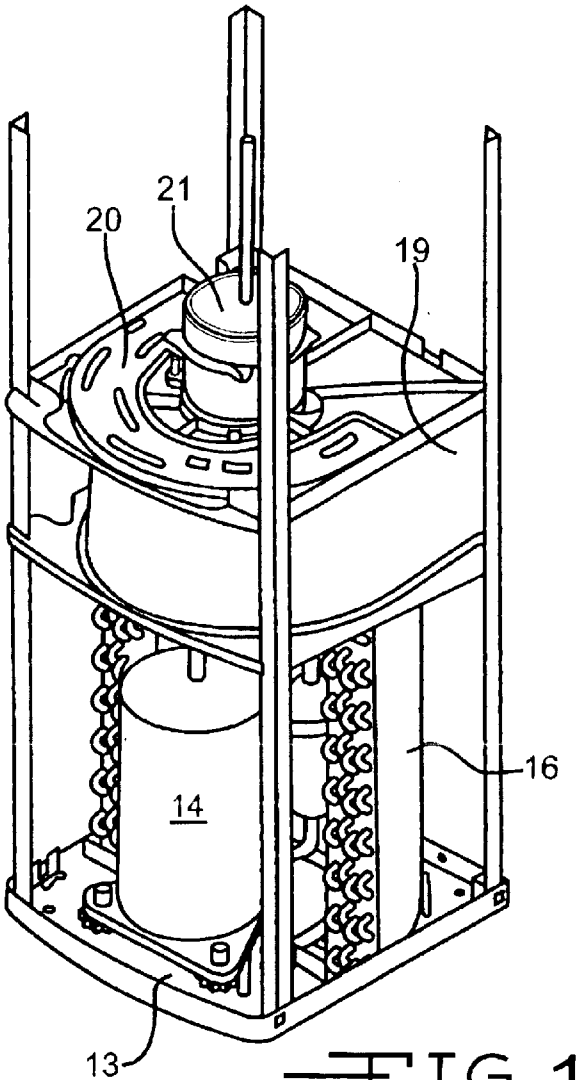
Figure 1F:
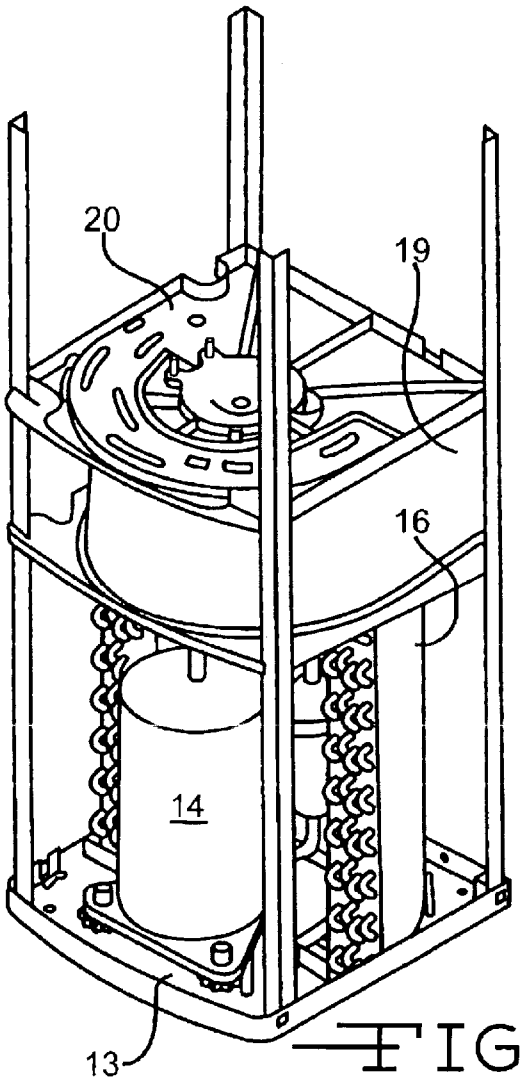
Figure 1I:
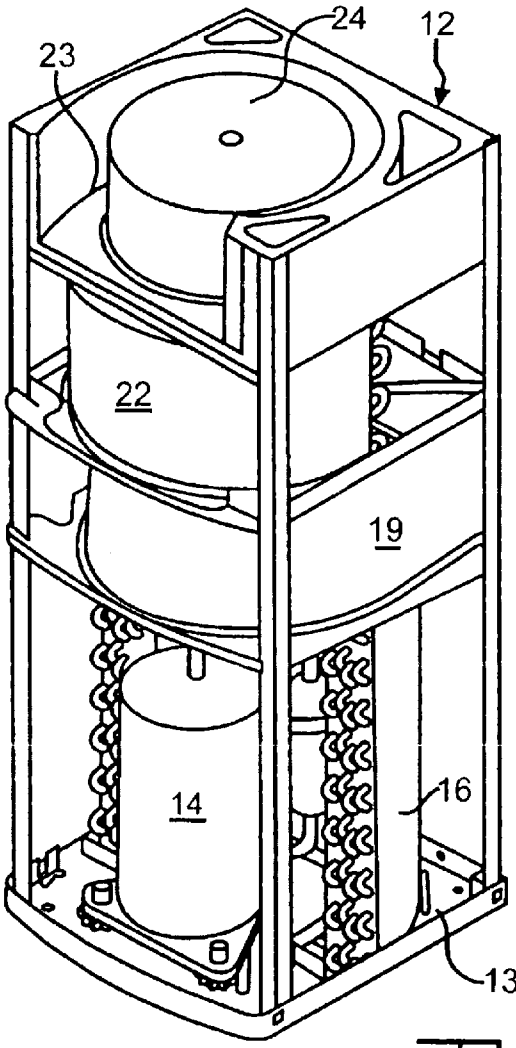
Figure 1H:
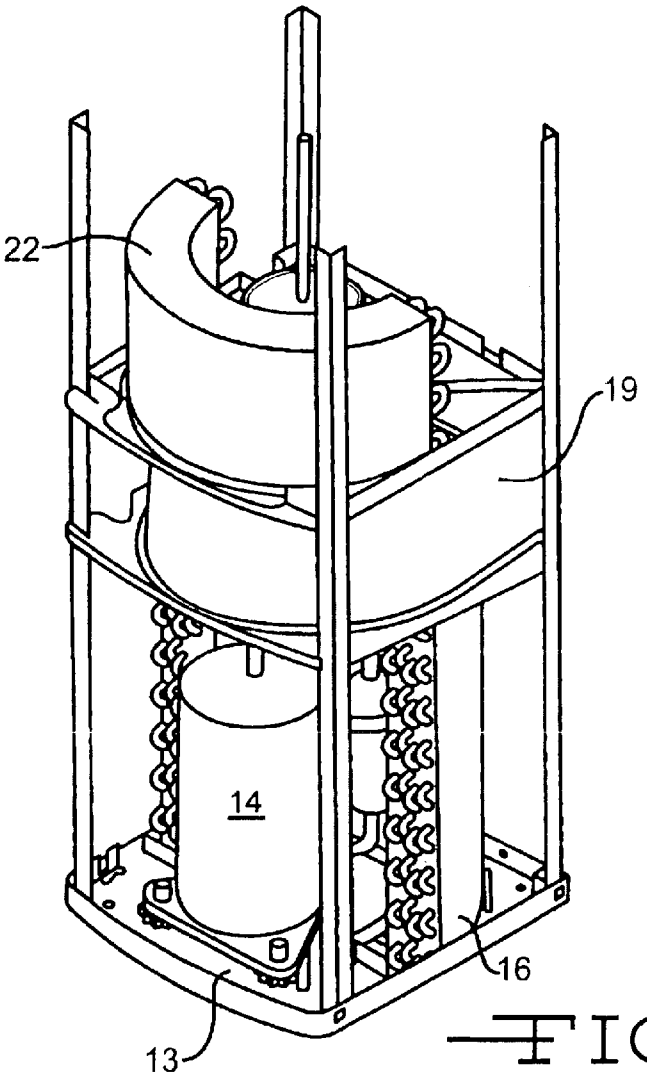
Figure 1J:
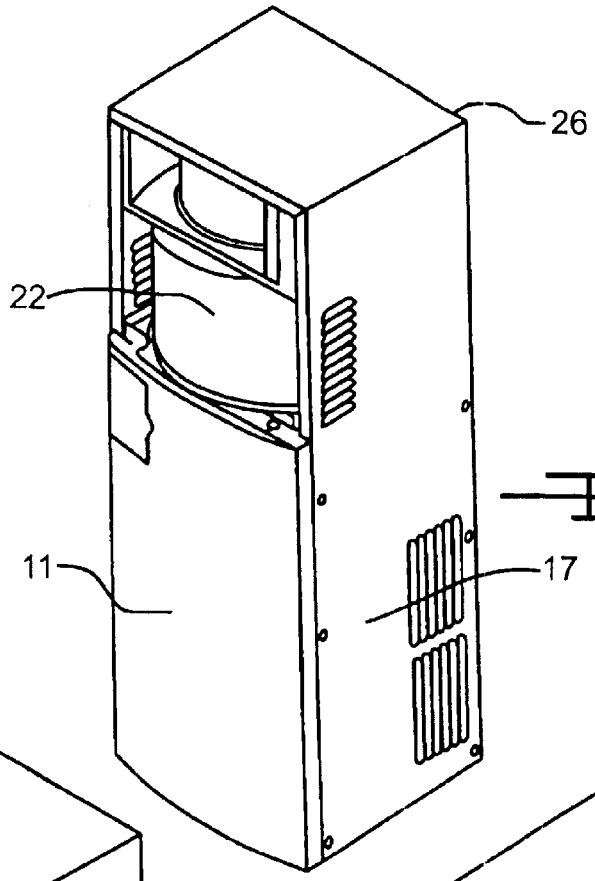
Figure 1K:
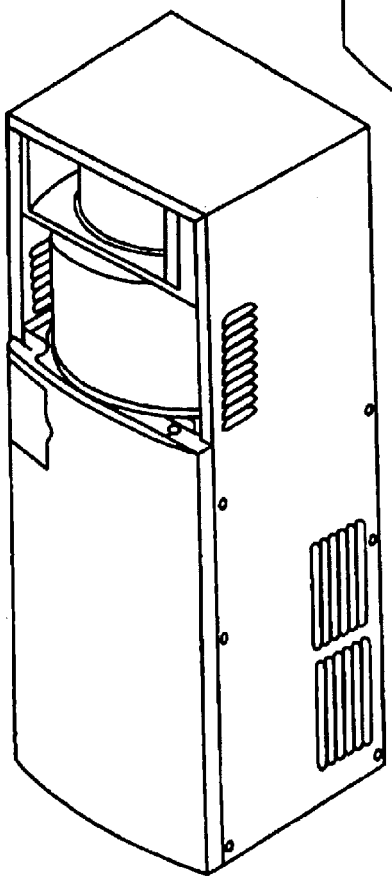
Figure 1L:
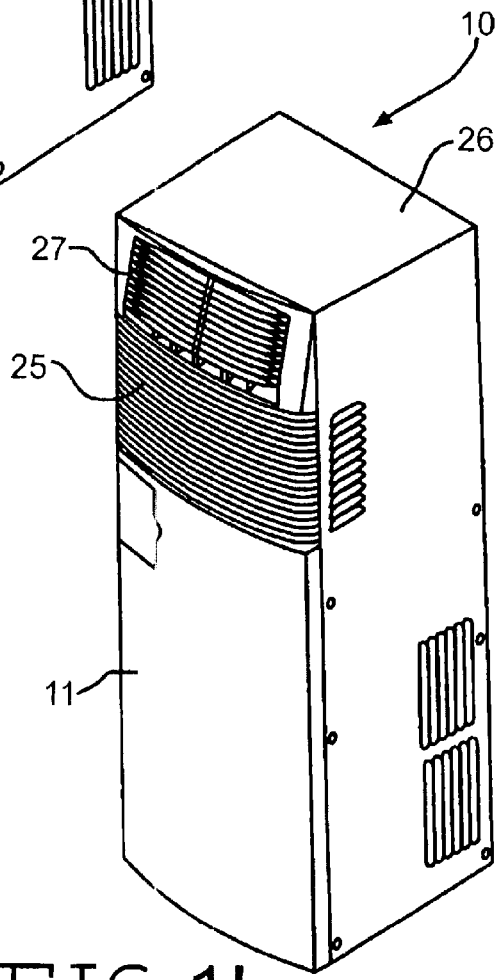
Figure 2:
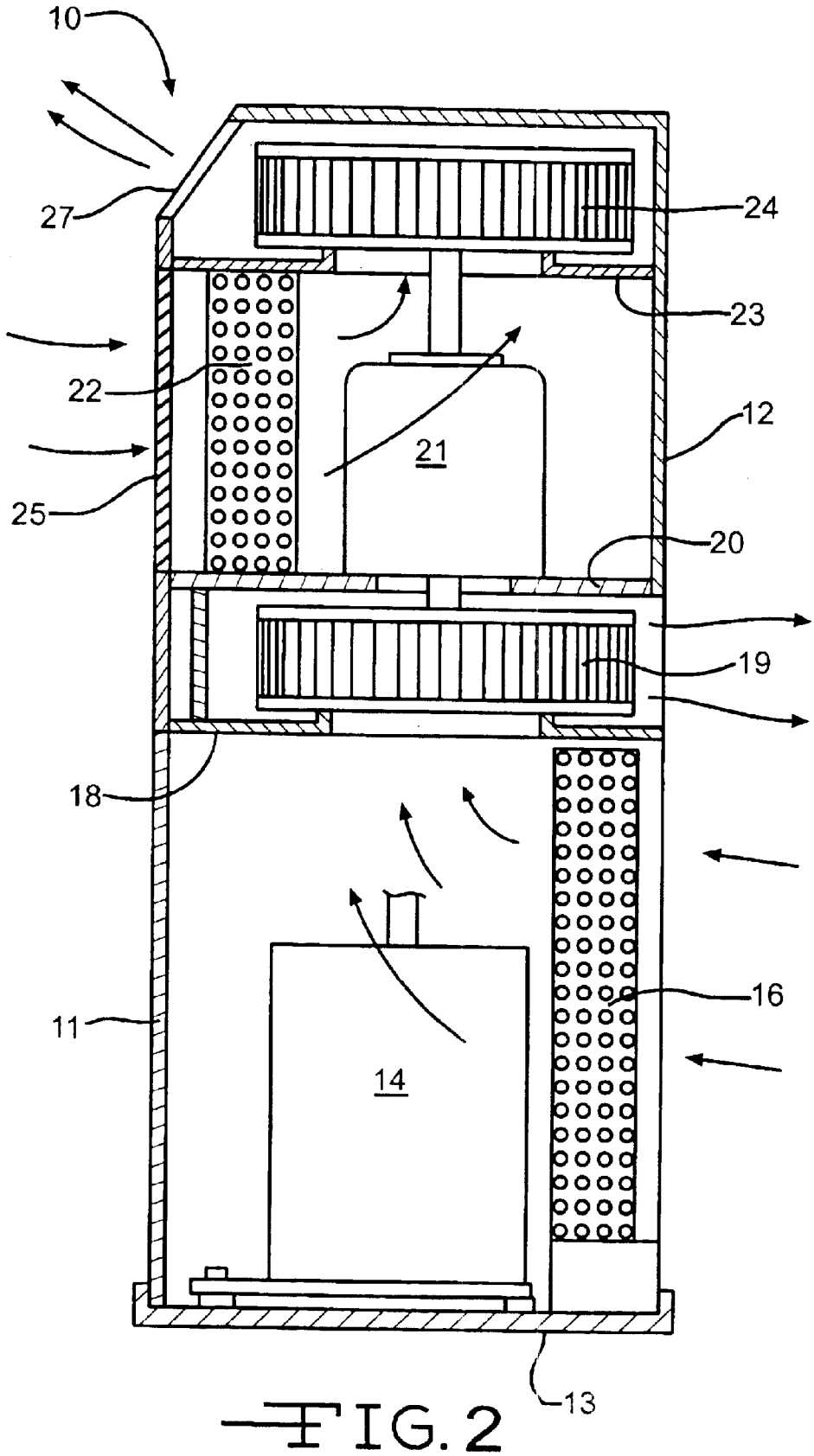
FIG. 2 is an enlarged sectional side elevation of the air-conditioner of FIG. 1 showing the main components.

Side panels 17 extend upwardly from the base pan 13 to the top of the air-conditioner. A horizontal partition 18 extends between the side panels 17 approximately mid-way between the top and bottom of the air-conditioner. An outdoor fan 19 is mounted above the partition 18 and although not clearly evident in the drawings is adapted to draw in air over the condenser coil 16 and discharge the air rearwardly from the air-conditioner above the condenser coil 16. The outdoor fan 19 draws air in axially and discharges the air radially through the back cover 12 which has suitable vents (not shown) for the purpose. The partition 18 has a suitable aperture (FIG. 2) for allowing air to be drawn in through the condenser coil 16.

A further partition 20 is arranged immediately above the outdoor fan 19 and completely divides the air-conditioner cabinet into two separate compartments vertically insofar as airflow is concerned. The further partition 20 forms a base on which fan motor 21 is mounted. The shaft of fan motor 21 is coaxial with the axis of rotation of the outdoor fan 19 and is connected to drive the outdoor fan 19. An evaporator 22 is also mounted on the further partition 20 and a top partition 23 is arranged immediately above the top edge of the evaporator 22. The top partition 23 extends horizontally and like the partition 18 contains an aperture for enabling air to pass therethrough. The shaft of fan motor 21 also extends through the aperture of top partition 23 to drive an indoor fan 24 which is mounted on the top partition 23. The indoor fan 24 is identical to the outdoor fan 19 with the exception that it is arranged to draw air in through the evaporator 22 and discharge the air through the front of the air-conditioner 10 and back into the room which the air-conditioner is designed to cool. An intake grill and filter 25 is fitted over the evaporator 22 in conformity with the front cover 11 and a top cover 26 is fitted to the top of the air-conditioner and has suitable outlet vents 27 for discharging cool air into the room. The outlet vents 27 may be adjusted to vary the direction of airflow into the room.

Figure 4:
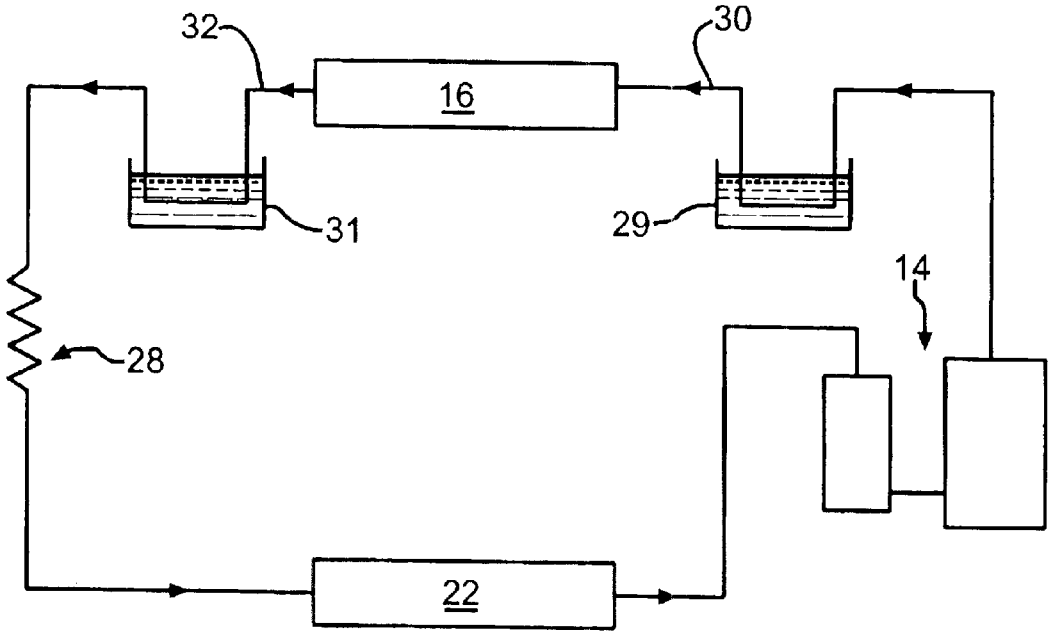
FIG. 4 is a schematic refrigerant circuit diagram of the air-conditioner of FIGS. 1 and 2.

As will be evident from the description above, the fan motor 21 is connected to drive the outdoor fan 19 which is coaxially arranged below the motor and the indoor fan 24 which is coaxially arranged above the motor. In this way the need for two separate fan motors is obviated. The general disposition of the various components should be more evident in the side elevation of FIG. 2. Although it is not evident in FIGS. 1 and 2, a water-collecting trough or pan is located immediately below the evaporator 22 and collects moisture from air which is being cooled by the evaporator coil. In other words, air from the room is drawn through the evaporator coil and moisture collects on the surface of the coil and ultimately drops into the trough or pan. Again, whilst it is not shown in FIGS. 1 and 2, this condensate, once collected, is drained to separate water containers located adjacent the condenser coil 16 such that the discharge pipe to the condenser coil passes through one container and the liquid pipe from the condenser coil passes through the other container. This feature is more clearly shown in the schematic diagram of FIG. 4, but firstly reference should be made to FIG. 5 which describes the major components of a conventional air-conditioner unit.

Figure 5:
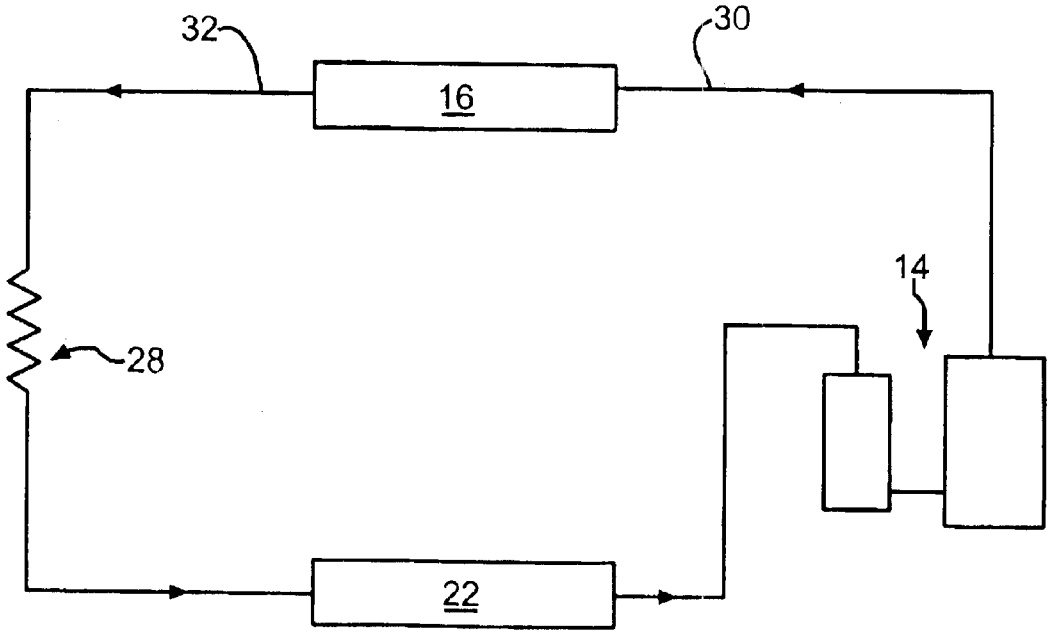
FIG. 5 is similar to FIG. 3 but for a conventional air-conditioner.

In FIG. 5 the condenser coil 16 and evaporator coil 22 are shown connected in the refrigerant hydraulic circuit. A metering device 28 is connected between the condenser coil 16 and the evaporator coil 22 such that refrigerant flows from the condenser coil through the metering device 28 to the evaporator coil. On the other side, the fluid outlet from the evaporator coil is connected to a two-stage compressor 14 and from the compressor to the inlet side of the condenser coil 16.

The air-conditioner of the present invention differs from the conventional air-conditioner described above as is shown more clearly in FIG. 4. The conventional components have the same reference numerals as in FIG. 5. However, as is evident in FIG. 4, a liquid container 29 is located adjacent one side of the condenser coil 16 and a discharge pipe 30 which carries refrigerant from the compressor to the condenser coil passes through the container 29. The container 29 receives water collected from the evaporator coil 22 as described above. Similarly, on the other side of the condenser coil 16 a second liquid container 31 is arranged in a manner whereby a liquid pipe 32 which carries refrigerant from the condenser coil to the metering device 28 passes through the liquid container 31. The liquid container 31 also receives water which is collected from the evaporator coil 22 as described above. In other words, the heat from the room is absorbed into the refrigerant (which is in the form of compressible liquid) through the evaporator coil. The refrigerant will change into gas form after it absorbs the heat from the room. It is then compressed to a high pressure by the compressor 14. The refrigerant rejects the heat energy through the condenser coil 16 and changes back to liquid form. It is then expanded to a lower pressure level and enters the evaporator coil again. This cycle is continued whilst the compressor 14 is operating. The water collected from the evaporator coil is used to cool down the condenser coil, by cooling the discharge pipe 30 and the liquid pipe 32 and this enhances the capacity of the condenser coil 16 in order to extract more heat energy from the refrigerant. As a further enhancement to this cooling of the condenser coil 16, a small additional pump (not shown) may be incorporated to create misty droplets of water to be sprayed to the surface of the condenser coil. This pump would spray some of the wastewater collected from the evaporator coil 22.

It should be apparent from the above that the air-conditioner of the present invention provides a number of improvements over conventional room air-conditioners. For example, the easy installation method facilitated by a floor standing unit that is accommodated in a pre-existing slot in a building wall, means that a purchaser is able to install the air-conditioner without any installation skill. In other words, a skilled trade's person is not required for installation purposes and for most purchasers it becomes a do-it-yourself (DIY) installation. This assumes of course that the building has an already provided aperture suitable for the air-conditioner with the necessary electrical outlet also in place. Furthermore, the compact design wherein the various components are displaced generally vertically relative to each other enables the air-conditioner to be constructed with a shallow depth of around 250 mm which corresponds to the wall thickness of most buildings. Likewise, the width of the air-conditioner is relatively narrow being again 250 mm in the preferred embodiment described above and it has a height of 815 mm. This means that a slot suitable for accommodating the air-conditioner can be readily created in a new or existing building wall. It also means that once the air-conditioner is installed in the slot, it is flush with both the inside and outside wall surfaces. In other words, there are no ugly protrusions from the building external wall or internally into the room for that matter, as with existing room air-conditioners. The use of a single motor to drive the fans for both the external and internal air is another feature which contributes to the compact and efficient design. In addition to the above, by using the condensate from the evaporator coil to cool the condenser coil or at least the inlet and outlet pipes connected to the condenser coil results in a more efficient operation of the condenser coil. It also avoids the need for draining the condensate to waste.

It should also be apparent to those skilled in the art that modifications may be made to the embodiment described above without departing from the spirit or scope of the invention. For example, the dimensions given in relation to the preferred embodiment are preferments only and could easily be varied to suit different wall thicknesses and different capacity air-conditioners. For example, the width and height of the air-conditioner may be varied whilst maintaining the depth at 250 mm but for some buildings the depth of the air-conditioner may also be varied to correspond to the wall thickness. Fastening means (not shown) which may take many different forms are provided on the air-conditioner for the purpose of attaching it to installation brackets (not shown) arranged within the wall slot. Because the air-conditioner is located at floor level, there is no lifting required in order to slip the air-conditioner into the slot and plug it in. Whilst none of the electrical connections are shown, clearly the air-conditioner incorporates appropriate switches and a thermostat to control its operation.

What is claimed is:

1. A room air conditioner for installation into a pre-constructed aperture through a building wall, which aperture extends upwardly from the building floor level, characterized in that, said air-conditioner has a depth substantially equivalent to the wall thickness and is adapted to stand at floor level within said aperture with front and rear faces substantially flush with internal and external surfaces of said wall, respectively.

2. A room air-conditioner as defined in claim 1, characterized in that, cooling air for the air-conditioner condenser coil is drawn in and extracted solely through said rear face of said air-conditioner.

3. A room air-conditioner as defined in claim 2, characterized in that, said air-conditioner includes fastening means for attaching said air-conditioner to installation brackets provided within said aperture.

4. A room air-conditioner as defined in claim 3, characterized in that, said condenser coil is mounted on or near a base pan of the air-conditioner adjacent said rear face thereof and an evaporator coil of the air-conditioner is mounted above the level of the condenser coil and adjacent said front face thereof, a first fan is provided above the level of said condenser coil[optl] for providing said cooling air for said condenser coil and a second similar fan is provided for drawing room air through said front face, over said evaporator coil whereby it is cooled, and discharging said cooled air into said room, and a single electric motor is provided for driving said fans.

5. A room air-conditioner as defined in claim 4, characterized in that, said fans are mounted with their rotational axes coaxial and said motor is arranged between said fans with the motor rotational axis co-axial with the rotational axes of said fans.

6. A room air-conditioner as defined in claim 5, characterized in that, condensate is collected from said evaporator coil and used to cool refrigerant pipes into and out of said condenser coil.

7. A room air-conditioner as defined in claim 6, characterized in that, said condensate is also sprayed onto said condenser coil for cooling purposes.

8. A room air-conditioner as defined in claim 7, characterized in that, said condensate flows under gravity into two separate containers arranged adjacent said condenser coil, and said refrigerant pipes into and out of said condenser coil pass through respective said containers for cooling purposes.

9. A room air conditioner as defined in claim 4, characterized in that, said condenser and evaporator coils are of C-shaped cross-section.

10. A room air-conditioner as defined in claim 1, characterized in that, said condenser and evaporator coils are of C-shaped cross-section.

11. A room air-conditioner, characterized in that, a single electric motor is used to drive both an evaporator fan for drawing room air through an evaporator coil and discharging said air back into said room, and a condenser fan for drawing external air through a condenser coil for cooling purposes and discharging said air externally of said room;

said shafts extending vertically and said fans being adapted to draw air into said fan axially and discharge the air radially;

said fans being mounted in coaxial alignment in said electric motor being mounted between said fans with its axis coaxial therewith, said shaft of said motor being connected at respective ends directly with drive shafts of said fans;

said evaporator and condenser coils being of C-shaped cross-section;

said room air conditioner further characterized in that condensate collected from an evaporator coil as utilized to cool refrigerant pipes entering and leaving a condenser coil of said air conditioner;

said condensate so collected being sprayed onto said condenser coil for cooling purposes;

wherein a drain pan under said evaporator coil collects said condensate and wherein pipe means delivers said condensate by gravity to container means adjacent said condenser coil, and inlet and outlet pipes of said condenser coil pass through said container means and are thereby cooled by said condensate, thus providing further cooling to said refrigerant; and wherein said pipe means comprises one or more pipes extending from said drain pan to said container means, and said container means comprises separate containers for said inlet and outlet pipes of said condenser coil.

12. A room air-conditioner as defined in claim 11, characterized in that, said air-conditioner is adapted for installation into a pre-constructed aperture through said external wall, which aperture extends upwardly from the building floor level and contains installation brackets to which said air-conditioner is attached, said air-conditioner having a depth substantially equivalent to the thickness of said external wall and being adapted to stand at floor level within said aperture with front and rear faces substantially flush with internal and external surfaces of said wall, respectively.

13. A room air-conditioner as defined in claim 12, characterized in that, said condenser coil is mounted on a base pan of the air-conditioner adjacent the rear face thereof and said evaporator coil is mounted above the level of the condenser coil and adjacent said front face, said air-conditioner further including a first fan arranged above the level of said condenser coil for providing cooling air for said condenser coil and second similar fan for drawing room air through said front face, over said evaporator coil whereby it is cooled, and discharging said cooled air into said room, and a single electric motor for driving said fans.

* * * * *